US009548022B2

(12) United States Patent
Kim et al.

(10) Patent No.: US 9,548,022 B2
(45) Date of Patent: Jan. 17, 2017

(54) PIXEL AND ORGANIC LIGHT EMITTING DISPLAY DEVICE INCLUDING CURRENT MIRROR

(71) Applicant: Samsung Display Co., Ltd., Yongin (KR)

(72) Inventors: Jeong-Hwan Kim, Yongin (KR); Sang-Ho Seo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/592,652

(22) Filed: Jan. 8, 2015

(65) Prior Publication Data

US 2015/0243215 A1 Aug. 27, 2015

(30) Foreign Application Priority Data

Feb. 24, 2014 (KR) ..... 10-2014-0021192

(51) Int. Cl.
*G09G 3/30* (2006.01)
*G09G 3/32* (2016.01)

(52) U.S. Cl.
CPC .... *G09G 3/3233* (2013.01); *G09G 2300/0426* (2013.01); *G09G 2300/0842* (2013.01); *G09G 2310/0251* (2013.01)

(58) Field of Classification Search
CPC .. G09G 3/3233; G09G 3/3241; G09G 3/3283; G09G 2300/0426; G09G 2300/0842; G09G 2310/0251; G09G 2320/0233
USPC ..... 345/77
See application file for complete search history.

(56) References Cited

U.S. PATENT DOCUMENTS

| | | | |
|---|---|---|---|
| 2003/0174152 | A1 | 9/2003 | Noguchi |
| 2005/0243586 | A1 | 11/2005 | Chung et al. |
| 2006/0108941 | A1 | 5/2006 | Yang et al. |

FOREIGN PATENT DOCUMENTS

| | | |
|---|---|---|
| KR | 10-2003-0066428 | 8/2003 |
| KR | 10-2005-0100888 | 10/2005 |
| KR | 10-0598431 | 7/2006 |

*Primary Examiner* — Gustavo Polo
(74) *Attorney, Agent, or Firm* — H.C. Park & Associates, PLC

(57) ABSTRACT

An organic light emitting display includes: pixels respectively positioned in areas defined by scan lines and data lines; and a data driver configured to supply a data signal to the data lines, the data signal includes a first data signal corresponding to an emission of the pixels and a second data signal corresponding to a non-emission of the pixels, wherein each pixel includes: an organic light emitting diode; a first transistor coupled to the organic light emitting diode, the first transistor configured to be a current source driven in a saturation region; a second transistor coupled as a current mirror to the first transistor, the second transistor configured to control an amount of a current flowing in the first transistor; and a third transistor coupled to the second transistor, the third transistor configured to be a switch driven in a linear region, according to the data signal.

4 Claims, 6 Drawing Sheets

PIXEL AND ORGANIC LIGHT EMITTING DISPLAY DEVICE INCLUDING CURRENT MIRROR

CROSS REFERENCE TO RELATED APPLICATION

This application claims priority from and the benefit of Korean Patent Application No. 10-2014-0021192, filed on Feb. 24, 2014, which is hereby incorporated by reference for all purposes as if fully set forth herein.

BACKGROUND

Field

Exemplary embodiments of the present invention relate to a pixel and an organic light emitting display using the same.

Discussion of the Background

With the development of information technologies, the importance of a display device as an interface between a user and information has increased. Accordingly, use of flat panel displays (FPDs), such as a liquid crystal display (LCD), an organic light emitting display device (OLED), and a plasma display panel (PDP), has increased.

Among these FPDs, the OLED displays images by using organic light emitting diodes that emit light through recombination of electrons and holes. The OLED has a fast response speed and is driven with low power consumption.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments of the present invention provide a pixel and an organic light emitting display using the same, which can improve display quality.

Additional features of the invention will be set forth in the description which follows, and in part will be apparent from the description, or may be learned by practice of the invention.

An exemplary embodiment of the present invention provides an organic light emitting display, including: pixels respectively positioned in areas defined by scan lines and data lines; and a data driver configured to supply a data signal to the data lines, the data signal includes a first data signal corresponding to an emission of the pixels and a second data signal corresponding to a non-emission of the pixels, wherein each pixel includes: an organic light emitting diode; a first transistor coupled to the organic light emitting diode, the first transistor configured to be a current source driven in a saturation region; a second transistor coupled as a current mirror to the first transistor, the second transistor configured to control an amount of a current flowing in the first transistor; and a third transistor coupled to the second transistor, the third transistor configured to be a switch driven in a linear region, according to the data signal.

An exemplary embodiment of the present invention provides a pixel, including: an organic light emitting diode including a cathode electrode coupled to a second power source; a first transistor coupled between a first power source and an anode electrode of the organic light emitting diode, wherein the first power source being set to a voltage higher than a voltage of the second power source, and the first transistor includes a gate electrode coupled to a first node; a second transistor including: a first electrode coupled to the first power source; and a gate electrode and a second electrode coupled to the first node; a third transistor coupled between the first node and the second power source, the third transistor including a gate electrode coupled to a second node; a fourth transistor coupled between a data line and the second node, the fourth transistor including a gate electrode coupled to a scan line; and a storage capacitor coupled between the first power source and the second node.

An exemplary embodiment of the present invention also provides a pixel, including: an organic light emitting diode including an anode electrode coupled to a first power source; a first transistor coupled between a cathode electrode of the organic light emitting diode and a second power source, wherein the second power source is set to a voltage lower than a voltage of the first power source, and the first transistor includes a gate electrode coupled to a first node; a second transistor including: a first electrode coupled to the second power source, a second electrode coupled to the first node, and a gate electrode; a third transistor coupled between the first power source and the first node, the third transistor including a gate electrode coupled to a second node; a fourth transistor coupled between a data line and the second node, the fourth transistor including a gate electrode coupled to a scan line; and a storage capacitor coupled between the second power source and the second node.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE DRAWINGS

Figure 1:
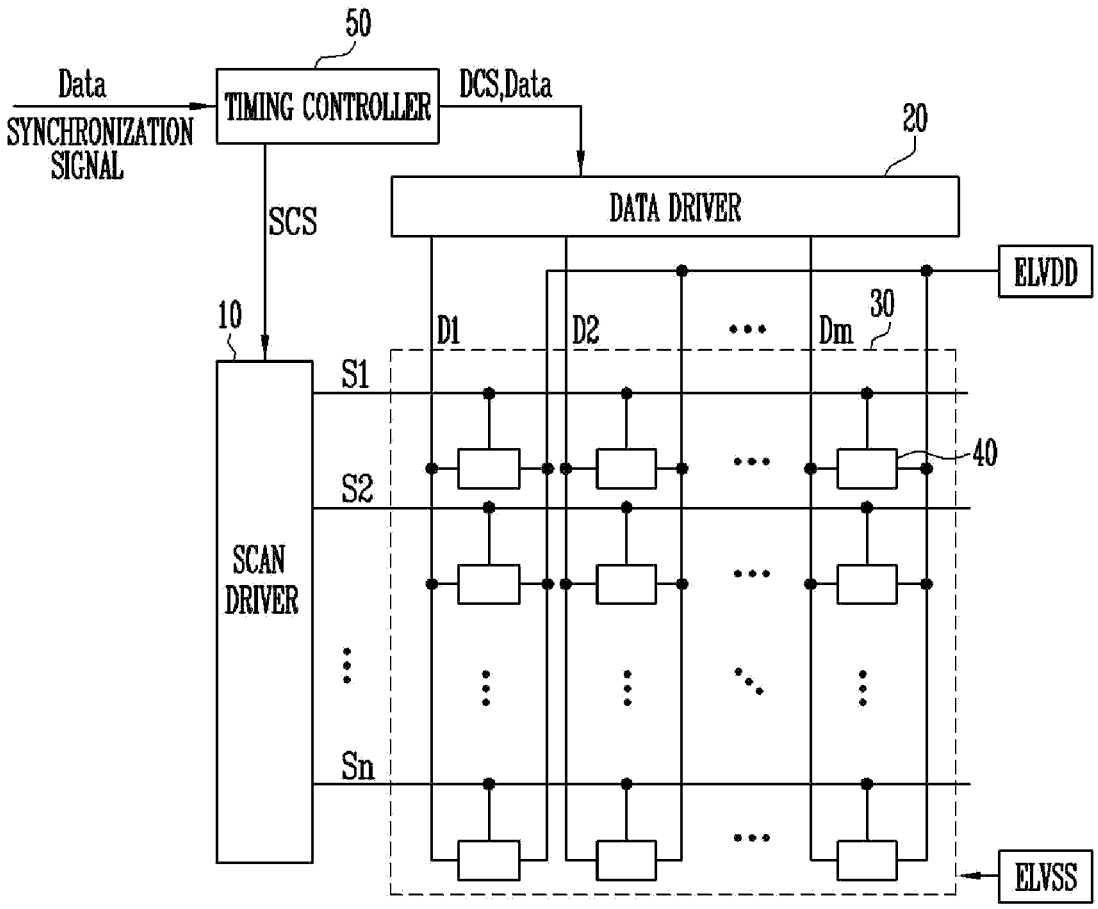
FIG. 1 is a diagram illustrating an organic light emitting display according to an exemplary embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a diagram illustrating an organic light emitting display according to an exemplary embodiment of the present invention.

Referring to FIG. 1, the organic light emitting display according to this exemplary embodiment includes a pixel unit 30, a scan driver 10, a data driver 20, and a timing controller 50. The pixel unit 30 includes pixels 40 respectively positioned in areas defined by scan lines S1 to Sn and data lines D1 to Dm. The scan driver 10 is configured to drive the scan lines S1 to Sn, and the data driver 20 is configured to drive the data lines D1 to Dm. The timing controller 50 is configured to control the scan driver 10 and the data driver 20.

The timing controller 50 generates a data driving control signal DCS and a scan driving control signal SCS, in response to synchronization signals from an outside thereof. The data driving control signal DCS generated in the timing controller 50 is supplied to the data driver 20, and the scan driving control signal SCS generated in the timing controller 50 is supplied to the scan driver 10. The timing controller 50 is configured to realign data Data from the outside for each subfield and supply the realigned data Data to the data driver 20.

Figure 2:
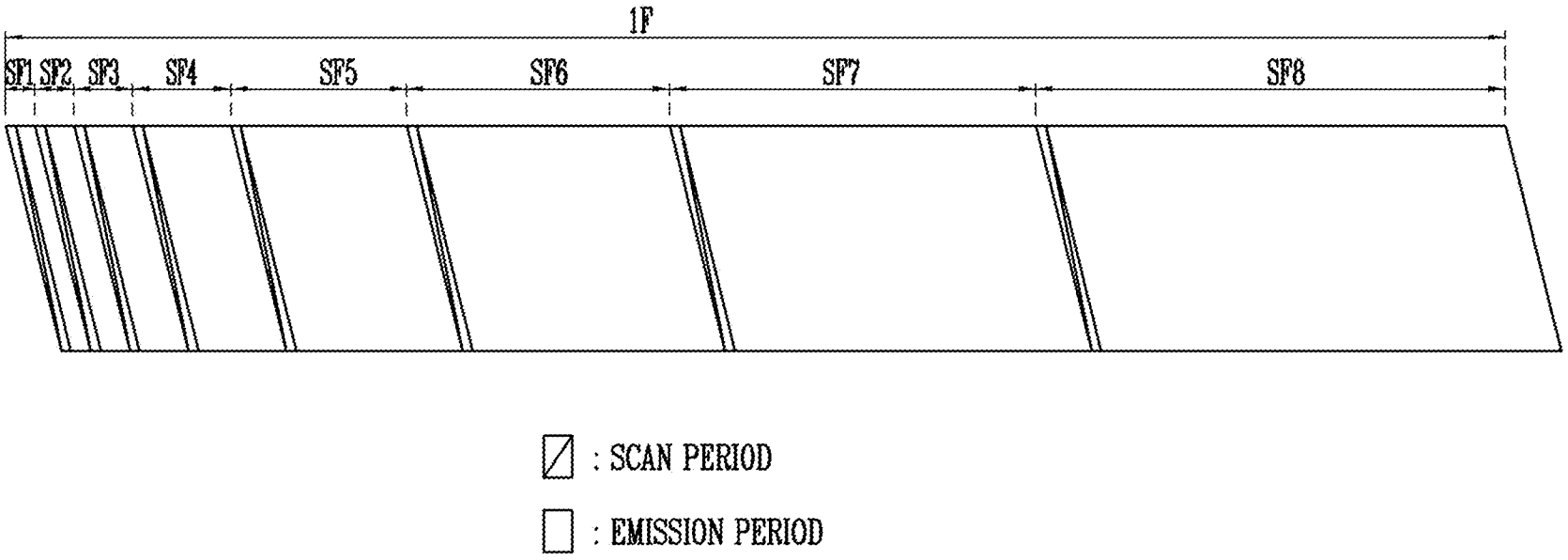
FIG. 2 is a diagram illustrating one frame according to an exemplary embodiment of the present invention.

The scan driver 10 supplies a scan signal to the scan lines S1 to Sn, corresponding to the scan driving control signal SCS. For example, the scan driver 10, as shown in FIG. 2, may supply a scan signal to the scan lines S1 to Sn every scan period of subframes SF1 to SF8 included in one frame 1F. If the scan signal is supplied to the scan lines S1 to Sn, pixels 40 connected to the scan lines S1 to Sn are selected for each horizontal line.

The method of supplying the scan signal in the scan driver 10 is not limited to the driving method of FIG. 2. The scan driver 10 of the exemplary embodiments of the present invention sequentially supplies the scan signal to the scan lines S1 to Sn, corresponding to various digital driving methods currently known in the art, or selects pixels 40 for each horizontal line while non-sequentially supplying the scan signal.

The data driver 20 generates a data signal, corresponding to the data driving control signal DCS, and supplies the generated data signal to the data lines D1 to Dm. The data signal supplied to the data lines D1 to Dm is supplied to the pixels 40 selected by the scan signal.

The data driver 20 supplies a data signal corresponding to either emission or non-emission of the pixel 40 according to the digital driving method. For example, the data driver 20 may supply a first data signal corresponding to the emission of the pixel 40 or a second data signal corresponding to the non-emission of the pixel 40. Accordingly, the pixel 40 receiving the first data signal supplied from the data driver 20 is set in an emission state during a corresponding subframe SF, and the pixel 40 receiving the second data signal supplied from the data driver 20 is set in a non-emission state during the corresponding subframe SF.

The pixel unit 30 includes the pixels 40 respectively positioned in the areas defined by the scan lines S1 to Sn and the data lines D1 to Dm. Each pixel 40 receives a first power source ELVDD and a second power source ELVSS set to a voltage lower than that of the first power source ELVDD. The pixel 40 implements a gray scale of a predetermined luminance while emitting light or not emitting light, corresponding to the data signal. Each pixel 40 includes a driving transistor configured to supply current to an organic light emitting diode while being driven as a current source in a saturation region. This will be described in detail later.

Figure 3:
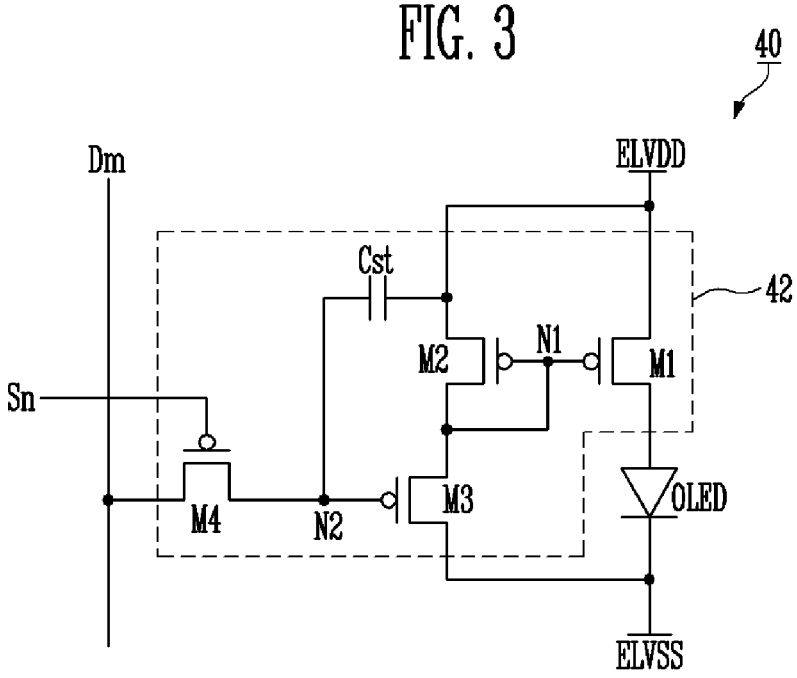
FIG. 3 is a circuit diagram illustrating a pixel according to an exemplary embodiment of the present invention.

FIG. 3 is a circuit diagram illustrating a pixel according to an exemplary embodiment of the present invention. For convenience of illustration, a pixel coupled to an m-th data line Dm and an n-th scan line Sn will be shown in FIG. 3.

Referring to FIG. 3, the pixel 40 according to this exemplary embodiment includes an organic light emitting diode OLED, and a pixel circuit 42 configured to control a current supplied to the organic light emitting diode OLED.

An anode electrode of the organic light emitting diode OLED is coupled to the pixel circuit 42, and a cathode electrode of the organic light emitting diode OLED is coupled to the second power source ELVSS. The organic light emitting diode OLED is set in the emission state when current is supplied from the pixel circuit 42, and is set in the non-emission state when the current is not supplied.

The pixel circuit 42 controls the current supplied to the organic light emitting diode OLED, corresponding to a data signal. For example, the pixel circuit 42 supplies the current to the organic light emitting diode OLED when the first data signal is supplied (emission state) and does not supply the current to the organic light emitting diode OLED when the second data signal is supplied (non-emission state). The pixel circuit 42 includes first to fourth transistors M1 to M4 and a storage capacitor Cst.

A first electrode of the second transistor M2 is coupled to the first power source ELVDD, and a second electrode and a gate electrode of the second transistor M2 are coupled to a first node N1 and a first electrode of the third transistor M3. The second transistor M2 is diode-coupled to supply current from the first power source ELVDD to the third transistor M3. The second electrode (drain electrode) and the gate electrode of the second transistor M2 are electrically coupled to each other, and hence the second transistor M2 is driven in the saturation region.

A first electrode of the first transistor (driving transistor) M1 is coupled to the first power source ELVDD, and a second electrode of the first transistor M1 is coupled to the anode electrode of the organic light emitting diode OLED. A gate electrode of the first transistor M1 is coupled to the first node N1 . The first transistor M1 is coupled to the second transistor M2 as a current mirror and controls the amount of current flowing from the first power source ELVDD to the organic light emitting diode OLED, corresponding to the current flowing in the second transistor M2.

The first transistor M1 is driven as a current source in the saturation region like the second transistor M2. Therefore, since a constant current is supplied from the first transistor M1 as the current source even though characteristics of the organic light emitting diode OLED are changed, it is possible to decrease the reduction of luminance. Also, since the first transistor M1 is driven as the current source, the voltage of the first power source ELVDD is not directly supplied to the anode electrode of the organic light emitting diode OLED, and accordingly, it is possible to reduce degradation of the organic light emitting diode OLED.

The third transistor M3 is coupled between the first node N1 and the second power source ELVSS. A gate electrode of the third transistor M3 is coupled to a second node N2. The third transistor M3 controls the electrical coupling between the second transistor M2 and the second power source ELVSS while being turned on or turned off corresponding to the data signal supplied to the second node N2. Therefore, the third transistor M3 is switch-driven (turned on or turned off) corresponding to the data signal. The third transistor M3 is driven in a linear region.

The fourth transistor M4 is coupled between the data line Dm and the second node N2. A gate electrode of the fourth transistor M4 is coupled to the scan line Sn. The fourth transistor M4 is turned on when a scan signal is supplied to the scan line Sn to supply the data signal from the data line Dm to the second node N2.

The storage capacitor Cst is coupled between the first power source ELVDD and the second node N2. The storage capacitor Cst stores the voltage of the data signal applied to the second node N2.

According to the exemplary embodiment of the present invention, the first to fourth transistors M1 to M4 are all formed of p-channel metal-oxide-semiconductor transistors (hereinafter, PMOS transistors), and the number of masks is minimized or decreased in a forming process, thereby reducing fabrication cost.

Figure 4:
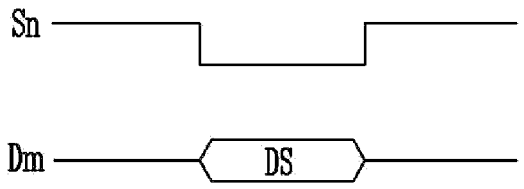
FIG. 4 is a waveform diagram illustrating a driving method of the pixel shown in FIG. 3.

FIG. 4 is a waveform diagram illustrating a driving method of the pixel shown in FIG. 3.

Referring to FIG. 4, when the scan signal is supplied to the scan line Sn, the fourth transistor M4 is turned on. When the fourth transistor M4 is turned on, the data signal from the data line Dm is supplied to the second node N2.

When the first data signal DS (e.g., a low voltage) corresponding to the emission of the pixel 40 is supplied, the third transistor M3 is turned on. The voltage of the first data signal DS is also stored in the storage capacitor Cst.

When the third transistor M3 is turned on, the second transistor M2 and the second power source ELVSS are electrically coupled to each other. Then, the diode-coupled second transistor M2 supplies a predetermined current from the first power source ELVDD to the second power source ELVSS while being driving as a current source.

The first transistor M1 coupled as a current mirror to the second transistor M2 also supplies a predetermined current from the first power source ELVDD to the second power source ELVSS via the organic light emitting diode OLED, corresponding to the amount of current flowing in the second transistor M2. Accordingly, the organic light emitting diode OLED generates light with a predetermined luminance, corresponding to the current supplied from the first transistor M1.

When the second data signal DS (e.g., a high voltage) corresponding to the non-emission of the pixel 40 from the data line Dm, the third transistor M3 is turned off. When the third transistor M3 is turned off, the second transistor M2 and the second power source ELVSS are electrically decoupled from each other. Thus, no current flows from the second transistor M2, and accordingly, the current is not supplied to the organic light emitting diode OLED from the first transistor M1 coupled as the current mirror to the second transistor M2. Accordingly, the organic light emitting diode OLED is set in the non-emission state.

According to the exemplary embodiment of the present invention, gray scale may be implemented by the emission of the organic light emitting diode OLED while repeating the process described above. The first transistor M1 may be driven as the current source in the saturation region, and hence a constant current can be supplied regardless of the degradation of the organic light emitting diode OLED, thereby improving display quality. Further, when the first transistor M1 is driven as the current source, the degradation of the organic light emitting diode OLED is minimized, thereby improving the display quality.

According to the exemplary embodiment of the present invention, the amount of current supplied to the organic light emitting diode OLED can be controlled by adjusting the channel/length W/L of the second transistor M2 and/or the first transistor M1. Therefore, the luminance in the emission of the organic light emitting diode OLED can be controlled by adjusting the channel/length W/L of the second transistor M2 and/or the first transistor M1.

Figure 5:
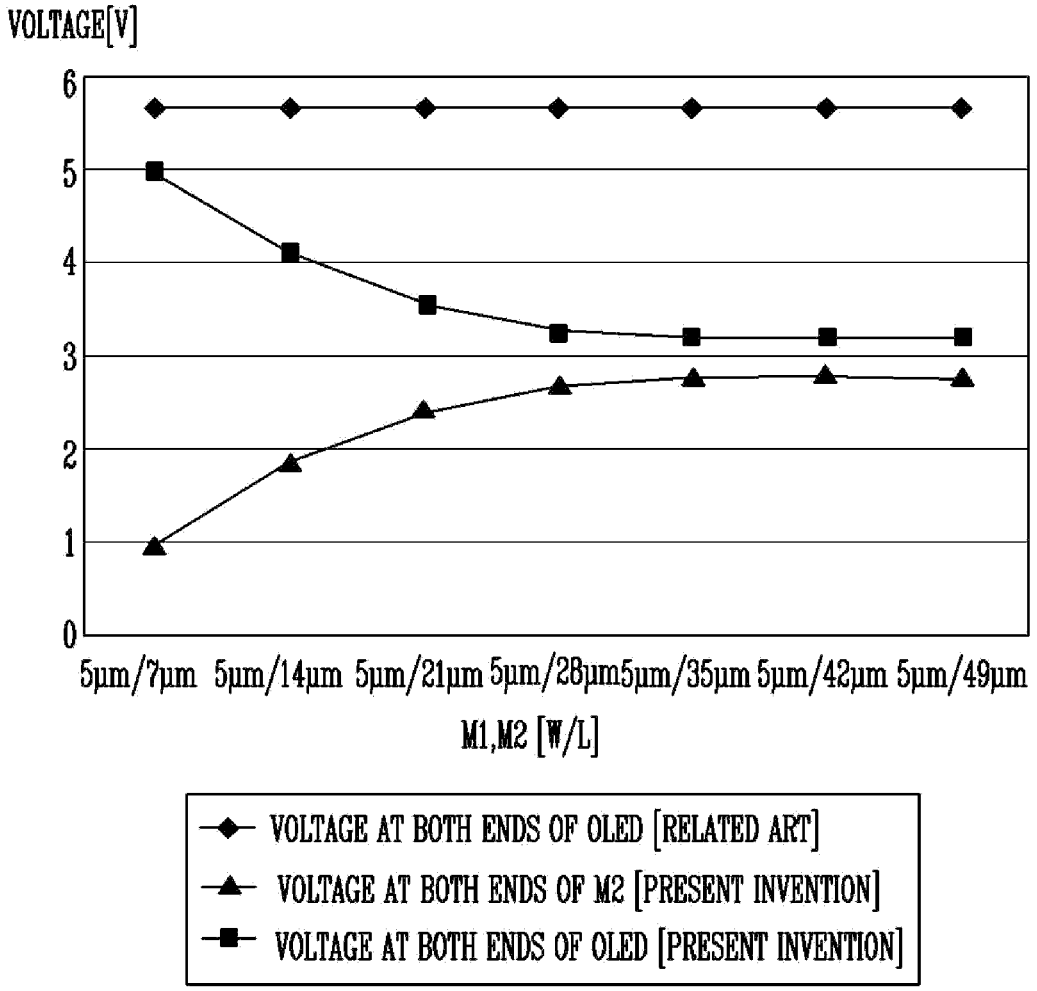
FIG. 5 is a graph illustrating a change in voltage of an organic light emitting diode, corresponding to changes in W/L of first and second transistors shown in FIG. 3.

FIG. 5 is a graph illustrating a change in voltage of the organic light emitting diode, corresponding to changes in W/L of the first and second transistors M1 and M2 shown in FIG. 3.

Referring to FIG. 5, in a general digital driving method of related art, the driving transistor is driven as a switch in the linear region. Therefore, a constant voltage is applied at both ends of the organic light emitting diode OLED, regardless of the W/L of the driving transistor. According to the general digital driving method of related art, a high voltage is applied at both the ends of the organic light emitting diode OLED, and accordingly, the degradation of the organic light emitting diode OLED is rapidly progressed.

According to the exemplary embodiment of the present invention, the first and second transistors M1 and M2 are driven in the saturation region, and hence the amount of current supplied to the organic light emitting diode OLED is changed corresponding to a change in channel/length W/L. Accordingly, the voltage at both the ends of the organic light emitting diode OLED is changed. That is, as the length L of the first and second transistors M1 and M2 becomes greater, the voltage at both the ends of the organic light emitting diode OLED is decreased, and the voltage at both ends of the second transistor M2 is increased.

The channel/length W/L of the first and second transistors M1 and M2 may be experimentally determined by considering the lifespan, luminance and the like of the organic light emitting diode OLED.

Figure 6:
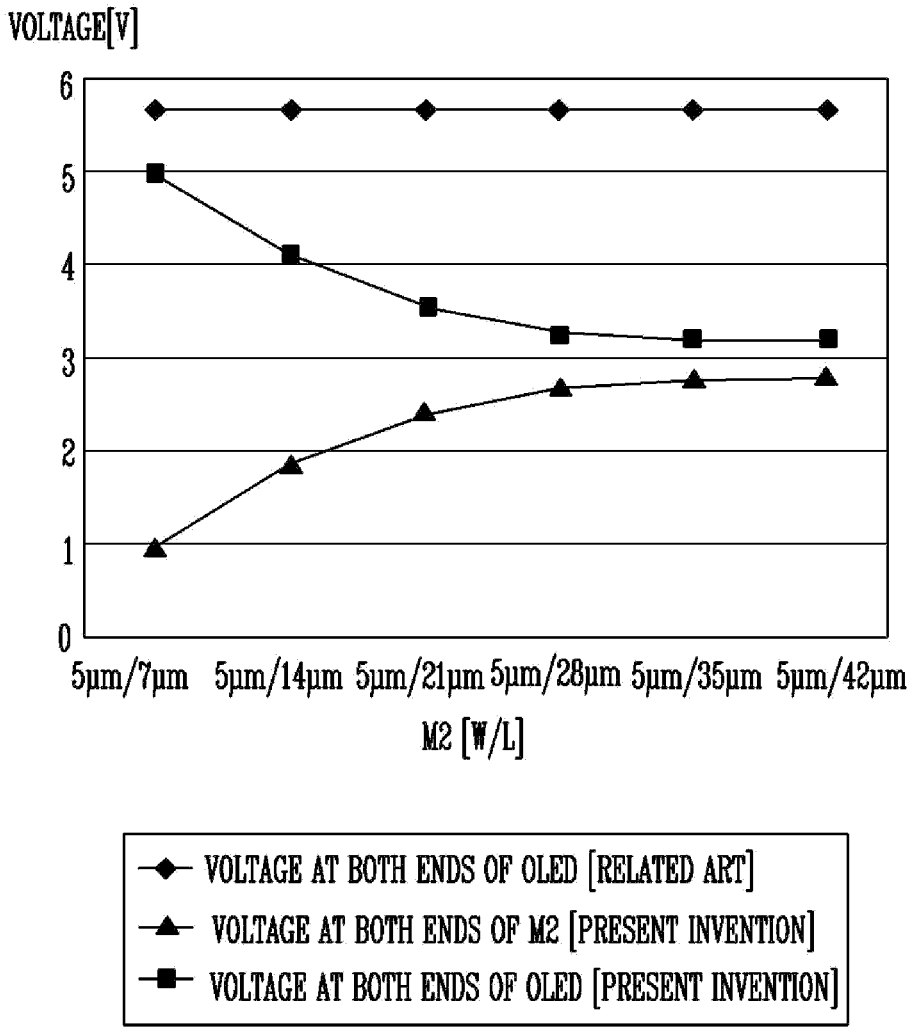
FIG. 6 is a graph illustrating a change in voltage of the organic light emitting diode, corresponding to a change in W/L of the second transistor shown in FIG. 3.

FIG. 6 is a graph illustrating a change in voltage of the organic light emitting diode, corresponding to a change in W/L of the second transistor M2 shown in FIG. 3.

Referring to FIG. 6, in the general digital driving method of related art, the driving transistor is driven in the linear region, and hence a constant voltage is applied at both the ends of the organic light emitting diode OLED, regardless of a change in W/L of the driving transistor.

According to the exemplary embodiment of the present invention, the second transistor M2 is driven in the saturation region, and hence the amount of current supplied to the organic light emitting diode OLED is changed corresponding to a change in channel/length W/L of the second transistor M2. Accordingly, the voltage at both the ends of the organic light emitting diode OLED is changed. That is, as the length L of the second transistor M2 becomes greater, the voltage at both the ends of the organic light emitting diode OLED is decreased, and the voltage at both the ends of the second transistor M2 is increased.

The channel/length W/L of the second transistor M2 may be experimentally determined by considering the lifespan, luminance and the like of the organic light emitting diode OLED. Similarly, the channel/length W/L of the first transistor M1 formed as the current mirror with the second transistor M2 may also be experimentally determined by considering the lifespan, luminance and the like of the organic light emitting diode OLED.

Figure 7:
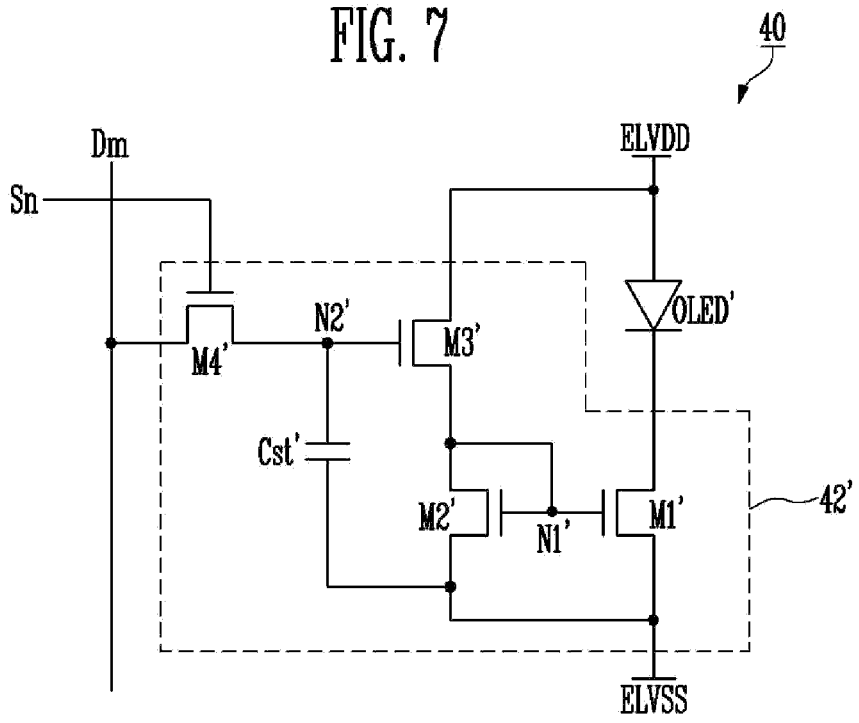
FIG. 7 is a circuit diagram illustrating a pixel according to an exemplary embodiment of the present invention.

FIG. 7 is a circuit diagram illustrating a pixel according to an exemplary embodiment of the present invention. For convenience of illustration, a pixel coupled to an m-th data line Dm and an n-th scan line Sn will be shown in FIG. 7. The transistors M1 to M4 in the pixel of FIG. 7 are formed of n-channel metal-oxide-semiconductor transistors (hereinafter, NMOS transistors) compared to the PMOS transistors M1 to M4 illustrated in FIG. 3, and their substantial operations are identical to those of FIG. 3.

Referring to FIG. 7, the pixel 40 according to this exemplary embodiment includes an organic light emitting diode OLED', and a pixel circuit 42' configured to control the current supplied from the organic light emitting diode OLED'.

An anode electrode of the organic light emitting diode OLED' is coupled to the first power source ELVDD, and a cathode electrode of the organic light emitting diode OLED' is coupled to the pixel circuit 42'. The organic light emitting diode OLED' is set in the emission or non-emission state, corresponding to the control of the pixel circuit 42'.

The pixel circuit 42' controls the emission or non-emission of the organic light emitting diode OLED', corresponding to a data signal. For example, the pixel circuit 42' supplies the current to the organic light emitting diode OLED' when the first data signal is supplied (emission state) and does not supply the current to the organic light emitting diode OLED' when the second data signal is supplied (non-emission state). The pixel circuit 42' includes first to fourth transistors M1' to M4' and a storage capacitor Cst'.

A first electrode of the second transistor M2' is coupled to the second power source ELVSS, and a second electrode and a gate electrode of the second transistor M2' are coupled to a first node N1' and a first electrode of the third transistor M3'. The second transistor M2' is diode-coupled to supply current supplied via the third transistor M3' to the second power source ELVSS. The second electrode (drain electrode) and the gate electrode of the second transistor M2' are electrically coupled to each other, and hence the second transistor M2' is driven in the saturation region.

A first electrode of the first transistor (driving transistor) M1' is coupled to the second power source ELVSS, and a second electrode of the first transistor M1' is coupled to the cathode electrode of the organic light emitting diode OLED'. The first transistor M1' is coupled as a current mirror to the second transistor M2', and controls the amount of current flowing from the organic light emitting diode OLED' to the second power source ELVSS, corresponding to the current flowing in the second transistor MT.

The first transistor M1' is driven as a current source in the saturation region like the second transistor M2. Therefore, since a constant current flows in the first transistor M1' as the current source even though characteristics of the organic light emitting diode OLED' are changed, it is possible to decrease the reduction of luminance. Also, since the first transistor M1' is driven as the current source, the voltage of the second power source ELVSS is not directly supplied to the cathode electrode of the organic light emitting diode OLED', and accordingly, it is possible to minimize degradation of the organic light emitting diode OLED'.

The third transistor M3' is coupled between the first node N1' and the first power source ELVDD. A gate electrode of the third transistor M3' is coupled to a second node N2'.

The third transistor M3' controls the electrical coupling between the second transistor M2' and the first power source ELVDD while being turned on or turned off corresponding to the data signal supplied to the second node N2'. Therefore, the third transistor M3' is switch-driven (turned on or turned off) corresponding to the data signal. The third transistor M3' is driven in the linear region.

The fourth transistor M4' is coupled between the data line Dm and the second node N2'. A gate electrode of the fourth transistor M4' is coupled to the scan line Sn. The fourth transistor M4' is turned on when the scan signal is supplied to the scan line, to supply the data signal from the data line Dm to the second node NT.

The storage capacitor Cst' is coupled between the second power source ELVSS and the second node NT. The storage capacitor Cst' stores the voltage of the data signal applied to the second node NT.

According to the exemplary embodiment of the present invention, the first to fourth transistors M1' to M4' are formed as NMOS transistors, and the number of masks is minimized in a forming process, thereby reducing fabrication cost.

Figure 8:
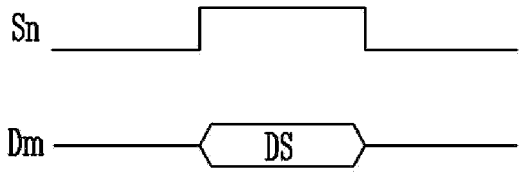
FIG. 8 is a waveform diagram illustrating a driving method of the pixel shown in FIG. 7.

FIG. 8 is a waveform diagram illustrating a driving method of the pixel shown in FIG. 7.

Referring to FIG. 8, when the scan signal is supplied to the scan line, the fourth transistor M4' is turned on. When the fourth transistor M4' is turned on, the data signal supplied from the data line Dm is supplied to the second node NT. When the first data signal DS (e.g., a high voltage) corresponding to the emission of the pixel 40 is supplied, the third transistor M3' is turned on. The voltage of the first data signal DS is also stored in the storage capacitor Cst'.

When the third transistor M3' is turned on, the second transistor MT and the first power source ELVDD are electrically coupled to each other. Then, the diode-coupled second transistor MT supplies a predetermined current from the first power source ELVDD to the second power source ELVSS while being driven as a current source.

The first transistor M1' coupled as the current mirror to the second transistor M2' also controls the amount of current flowing from the first power source ELVDD to the second power source ELVSS via the organic light emitting diode OLED', corresponding to the amount of current flowing in the second transistor M2'. Accordingly, the organic light emitting diode OLED' generates light with a predetermined luminance, corresponding to the current flowing in the first transistor M1'.

When the second data signal DS (e.g., a low voltage) corresponding to the non-emission of the pixel 40 from the data line Dm is supplied, the third transistor M3' is turned off. When the third transistor M3' is turned off, the second transistor MT and the first power source ELVDD are electrically decoupled from each other. Thus, the second transistor MT and the first transistor M1', which is coupled to the second transistor MT as the current mirror, are turned off. In this case, the organic light emitting diode OLED' is set in the non-emission state.

According to the exemplary embodiment of the present invention, gray scale may be implemented by the emission of the organic light emitting diode OLED' while repeating the process described above. The first transistor M1' may be driven as the current source in the saturation region, and hence a constant current can be supplied regardless of the degradation of the organic light emitting diode OLED', thereby improving display quality. Further, when the first transistor M1 is driven as the current source, the degradation of the organic light emitting diode OLED' is minimized, thereby improving the display quality.

According to the exemplary embodiment of the present invention, the amount of current supplied to the organic light emitting diode OLED' can be controlled by adjusting the channel/length W/L of the second transistor MT and/or the first transistor M1'. Therefore, the luminance in the emission of the organic light emitting diode OLED' can be controlled by adjusting the channel/length W/L of the second transistor M2' and/or the first transistor M1'.

According to the exemplary embodiment of the present invention, the organic light emitting diode OLED may generate red, green and blue light, and/or white light, corresponding to the amount of the current supplied from the driving transistor. When the organic light emitting diode OLED is configured to generate white light, a color image may be implemented using a separate color filter or the like.

An organic light emitting display may be driven by an analog or a digital driving method. According to the analog driving method, a gray scale may be implemented using a voltage difference. According to the digital driving method, a gray scale may be implemented using a time difference.

According to the analog driving method, different data voltages are respectively applied to pixels, thereby implementing gray scales. That is, in the analog driving method, a corresponding data voltage according to each gray scale is generated, and the luminance of the pixels is controlled by applying the corresponding the data voltage. Accordingly, the data voltage may have a number of voltage levels corresponding to the number of gray scales. However, the analog driving method may show luminance variation due to characteristic variations of the pixels even when the same data voltage is supplied; and may express an imprecise gray scale.

According to the digital driving method, the emission and non-emission of each pixel, i.e., the display period of each pixel, is controlled, thereby implementing gray scales. In the digital driving method, it is possible to overcome the problem of imprecise gray scale, which may occur in the organic light emitting display driven by the analog driving method. Accordingly, the digital driving method in which gray scales are expressed by controlling the emission time of each pixel has recently been widely applied.

According to the analog driving method, a driving transistor is driven in a saturation region, i.e., as a static current source. Therefore, when the driving transistor is driven as the static current source, a voltage is not directly applied to an organic light emitting diode, and accordingly, a reduction in a lifespan of the organic light emitting diode may be decreased.

On the other hand, according to the digital driving method, the driving transistor is driven in a linear region, i.e., as a switch. Therefore, when the driving transistor is driven as the switch, the voltage is directly supplied to the organic light emitting diode, and accordingly, the life span of the organic light emitting diode may be reduced. That is, in the digital driving method, the reduction in luminance of the organic light emitting diode occurs faster when compared to the analog driving method, and the display quality may be decreased faster.

According to the pixel and the organic light emitting display including the exemplary embodiment of the present invention, the organic light emitting display is driven by the digital driving method, and the driving transistor is driven in the saturation region. Therefore, the degradation of the organic light emitting diode may be decreased, improving display quality. Further, since the driving transistor is driven as the current source in the saturation region, a constant current may be supplied regardless of a change in characteristic of the organic light emitting diode, improving the display quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display, comprising:

pixels respectively positioned in areas defined by scan lines and data lines; and a data driver configured to supply a data signal to the data lines, the data signal comprises a first data signal corresponding to an emission of the pixels and a second data signal corresponding to a non-emission of the pixels, wherein each pixel comprises:

an organic light emitting diode;

a first transistor coupled to the organic light emitting diode, the first transistor configured to be a current source driven in a saturation region, wherein a gate electrode of the first transistor is coupled to a first node;

a second transistor coupled as a current mirror to the first transistor, the second transistor configured to control an amount of a current flowing in the first transistor;

a third transistor coupled to the second transistor, the third transistor configured to be a switch driven in a linear region according to the data signal, wherein a gate electrode of the third transistor is coupled to a second node; and a storage capacitor coupled between a first power source and the second node, wherein the first transistor is coupled between an anode electrode of the organic light emitting diode and the first power source, wherein a first electrode of the second transistor is coupled to the first power source, and a second electrode and a gate electrode of the second transistor are coupled to the first node, and wherein the third transistor is coupled between the first node and a second power source, and the second power source being set to a voltage lower than a voltage of the first power source.

2. The organic light emitting display of claim 1, wherein each pixel further comprises:

a fourth transistor coupled to a data line and the second node, wherein a gate electrode of the fourth transistor is coupled to a scan line.

3. The organic light emitting display of claim 1, wherein the first transistor is configured to control an amount of a current flowing from the first power source to the second power source via the organic light emitting diode corresponding to the amount of the current flowing in the second transistor.

4. The organic light emitting display of claim 2, wherein the first to fourth transistors are formed as p-channel metal-oxide-semiconductor transistors.

* * * * *